United States Patent [19]

Ekelman, Jr. et al.

[11] Patent Number: 4,504,805

[45] Date of Patent: Mar. 12, 1985

[54] MULTI-PORT COMBINER FOR MULTI-FREQUENCY MICROWAVE SIGNALS

[75] Inventors: Ernest P. Ekelman, Jr., Bolingbrook; Edward L. Ostertag, New Lenox, both of Ill.

[73] Assignee: Andrew Corporation, Orland Park, Ill.

[21] Appl. No.: 384,997

[22] Filed: Jun. 4, 1982

[51] Int. Cl.[3] ..... H01P 1/161; H01P 5/12

[52] U.S. Cl. ..... 333/126; 333/135; 333/21 A

[58] Field of Search ..... 333/129, 126, 134, 135, 333/21 A; 343/786

[56] References Cited

U.S. PATENT DOCUMENTS

| | | | |
|---|---|---|---|
| 2,908,872 | 10/1959 | Garoff . | |
| 3,731,235 | 5/1973 | Ditullio et al. | 333/135 |
| 3,978,434 | 8/1976 | Morz et al. | 333/135 |
| 4,076,039 | 2/1978 | Ren et al. . | |
| 4,258,366 | 3/1981 | Green . | |
| 4,410,866 | 10/1983 | Bui-Hai | 333/135 |

OTHER PUBLICATIONS

Article Entitled "Frequency Reuse Feed for Domsat Ground Stations" by G. W. Collins.

Brochures entitled "*Test Protocol* for Linearly Polarized OMT with Mechanical Polarized Adjustment".

*Primary Examiner*—Paul Gensler

*Attorney, Agent, or Firm*—Leydig, Voit, Osann Mayer & Holt, Ltd.

[57] ABSTRACT

A combiner for transmitting and receiving co-polarized microwave signals in a selected propagation mode in at least two different frequency bands, the combiner comprising a main waveguide dimensioned to simultaneously propagate signals in the different frequency bands, at least a portion of the main waveguide being overmoded; at first and second junctions spaced along the length of the main waveguide for coupling signals in the different frequency bands in and out of the main waveguide, at least the first junction being located in an overmoded portion of the main waveguide and having side-arm waveguide means associated therewith for propagating signals in one of the different frequency bands; filtering means disposed within the main waveguide and operatively associated with the first and second junctions, the filtering means having (1) a stopband characteristic for coupling signals in a first one of the frequency bands between the main waveguide and the first junction and the side-arm waveguide means associated therewith, and (2) a passband characteristic for passing signals in a second one of the frequency bands past the first junction, the filtering means and the first junction suppressing spurious excitation of signals in undesired propagation modes different from the selected mode; and means for coupling signals in the second frequency band between the main waveguide and the second junction.

41 Claims, 20 Drawing Figures

MULTI-PORT COMBINER FOR MULTI-FREQUENCY MICROWAVE SIGNALS

TECHNICAL FIELD

The present invention relates generally to microwave systems, and, more particularly, to microwave combining networks commonly referred to as "combiners". Combiners are devices that are capable of simultaneously transmitting and/or receiving two or more different microwave signals. The present invention is particularly concerned with combiners which can handle co-polarized signals in two or more frequency bands and, if desired, in combination with one or more orthogonally polarized signals; the orthogonally polarized signals can also be handled in two or more frequency bands.

BACKGROUND ART

In the propagation of microwave signals, it is generally desired to confine the signals to one propagation mode in order to avoid the distortions that are inherent in multimode propagation. The desired propagation mode is usually the dominant mode, such as the $TE_{11}$ mode in circular waveguide. The higher order modes can be suppressed by careful dimensioning of the waveguide such that the higher order modes are below cutoff. In certain instances, however, it is necessary for portions of the waveguide to be large enough to support more than one mode, and a discontinuity in such a waveguide can give rise to undesired higher order modes. For this reason, such waveguide sections are often referred to as "multi-mode" or "overmoded" waveguide.

One example of a waveguide system that requires an overmoded waveguide section is a system that includes a multi-port, multi-frequency combiner. For example, four-port combiners are typically used to permit a single antenna to launch and/or receive microwave signals in two different frequency bands in each of two orthogonal polarizations. Each of these frequency bands is usually at least 500 MHz wide. For instance, present telecommunication microwave systems generally transmit signals in frequency bands which are referred to as the "4 GHz", "6 GHz" and "11 GHz" bands, but the actual frequency bands are 3.7 to 4.2 GHz, 5.925 to 6.425 GHz, and 10.7 to 11.7 GHz, respectively. Signals of a given polarization in any of these bands must be propagated through the combiner without perturbing signals in any other band, without perturbing orthogonally polarized signals in the same band, and without generating unacceptable levels of unwanted higher order modes of any of the signals.

Elaborate and/or costly precautions have previously been taken to avoid the discontinuities that could give rise to undesired higher order modes in multi-frequency combiners of the type described above. For example, U.S. Pat. No. 4,077,039 discloses such a combiner that uses a pseudo-balanced feed in the tapered portion of a flared horn, in combination with evanescent mode waveguide filters in the side arms of the high frequency port of the combiner. The basic dilemma posed by the multi-port, multi-frequency combiners is the undersired mode-generating discontinuities must be avoided in the overmoded waveguide sections, and yet some means must be provided for coupling selected signals with one or more ports located in the overmoded section of waveguide. Previous solutions of this dilemma have involved various complex, costly and/or physically cumbersome designs.

DISCLOSURE OF THE INVENTION

It is a primary object of the present invention to provide an improved combiner that can be economically manufactured and yet provides excellent performance characteristics when used with co-polarized signals in two or more frequency bands, even when the signals in one or more of the frequency bands are orthoganally polarized. In this connection, a related object of the invention is to provide such an improved combiner which can be made with a compact size and of relatively simple geometry.

It is another object of this invention to provide such an improved combiner which has low insertion losses, low VSWR, and a high degree of isolation among ports, frequency bands, and polarizations, even when the frequency bands have widths of 500 MHz or more.

A further object of the present invention is to provide an improved combiner that does not require any filters in the side arms (although such filters can be used as optional features if desired).

It is still another object of this invention to provide such an improved combiner which prevents the spurious excitation of unacceptable levels of unwanted higher order modes of the desired signals.

Yet another object of the invention is to provide an improved combiner of the foregoing type which greatly facilitates correction of antenna mis-alignment, both during original installation and in subsequent re-alignment operations. In this connection, a related object is to provide a combiner which permits an antenna to be precisely aligned without removing it from service.

A still further object of the invention is to provide such an improved combiner which can be made with any desired crosssectional configuration in the main waveguide, i.e., square, circular, rectangular, coaxial, quadruply ridged, etc.

Other objects and advantages of the invention will be apparent from the following detailed description.

In accordance with the present invention, there is provided a combiner for transmitting and receiving co-polarized microwave signals in a selected propagation mode in at least two different frequency bands, the combiner comprising a main waveguide dimensioned to simultaneously propagate signals in the different frequency bands, at least a portion of the main waveguide being overmoded; at first and second junctions spaced along the length of the main waveguide for coupling signals in the different frequency bands in and out of the main waveguide, at least the first junction being located in an overmoded portion of the main waveguide and having side-arm waveguide means associated therewith for propagating signals in one of the different frequency bands; filtering means disposed within the main waveguide and operatively associated with the first and second junctions, the filtering means having (1) a stopband characteristic for coupling signals in a first one of the frequency bands between the main waveguide and the first junction and the side-arm waveguide means associated therewith, and (2) a passband characteristic for passing signals in a second one of the frequency bands past the first junction, the filtering means and the first junction suppressing spurious excitation of signals in undesired propagation modes different from the selected mode; and means for coupling signals in the second frequency band between the main waveguide and the second junction.

In the preferred embodiment of the invention, the overmoded portion of the main waveguide is located at the open end of the waveguide through which all the multiple signals enter and exit the main waveguide; the junction or junctions for signals in the higher frequency band are located in the overmoded portion of the main waveguide; each higher frequency junction has a pair of diametrically opposed irises and sidearm waveguides to form a balanced junction, and the associated filtering means is also balanced to suppress spurious excitation of signals in undesired propagation modes; and each higher frequency junction and the filtering means associated therewith permit unimpeded passage of signals in the lower frequency band. To provide a four-port combiner, two high frequency junctions are provided in the overmoded section of the main waveguide for handling two orthogonally polarized high frequency signals, and two low frequency junctions are provided in the single-moded section of the main waveguide to handle two orthogonally polarized low frequency signals.

BEST MODE FOR CARRYING OUT THE INVENTION

Figure 1:
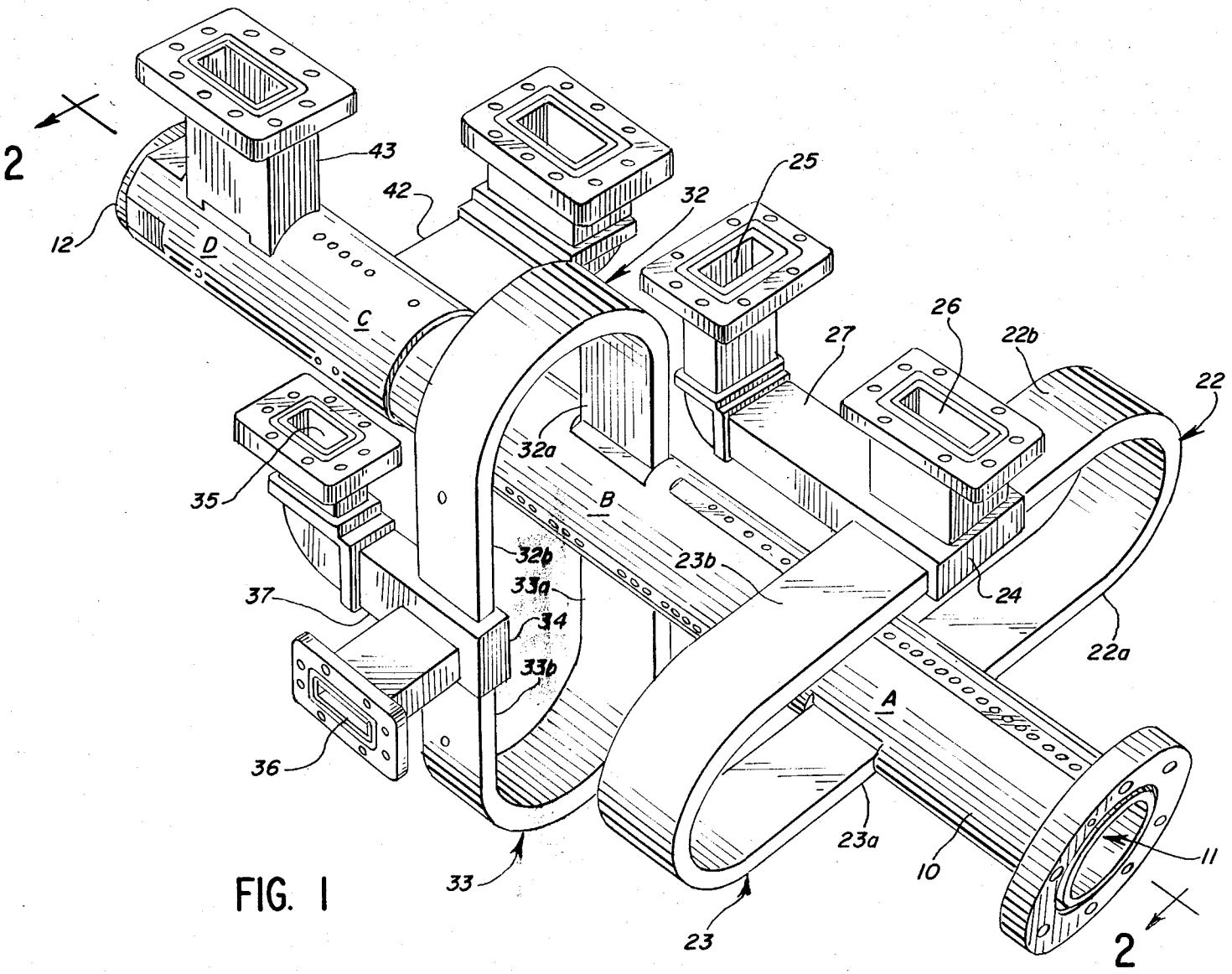
FIG. 1 is a perspective view of a four-port combiner embodying the present invention.
Figure 2:
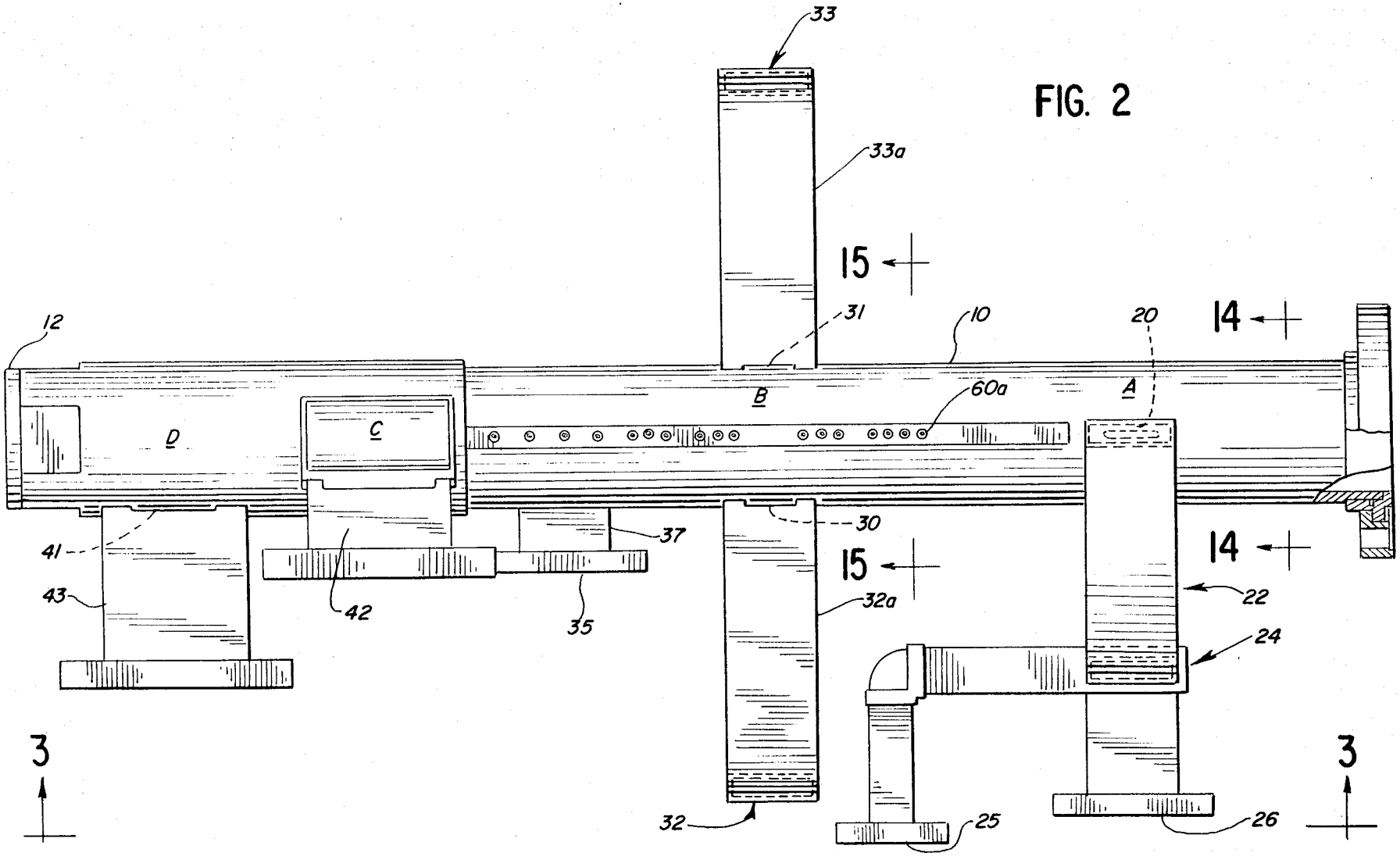
FIG. 2 is a front elevation of the combiner of FIG. 1 rotated 180° about the axis of the main waveguide.
Figure 3:
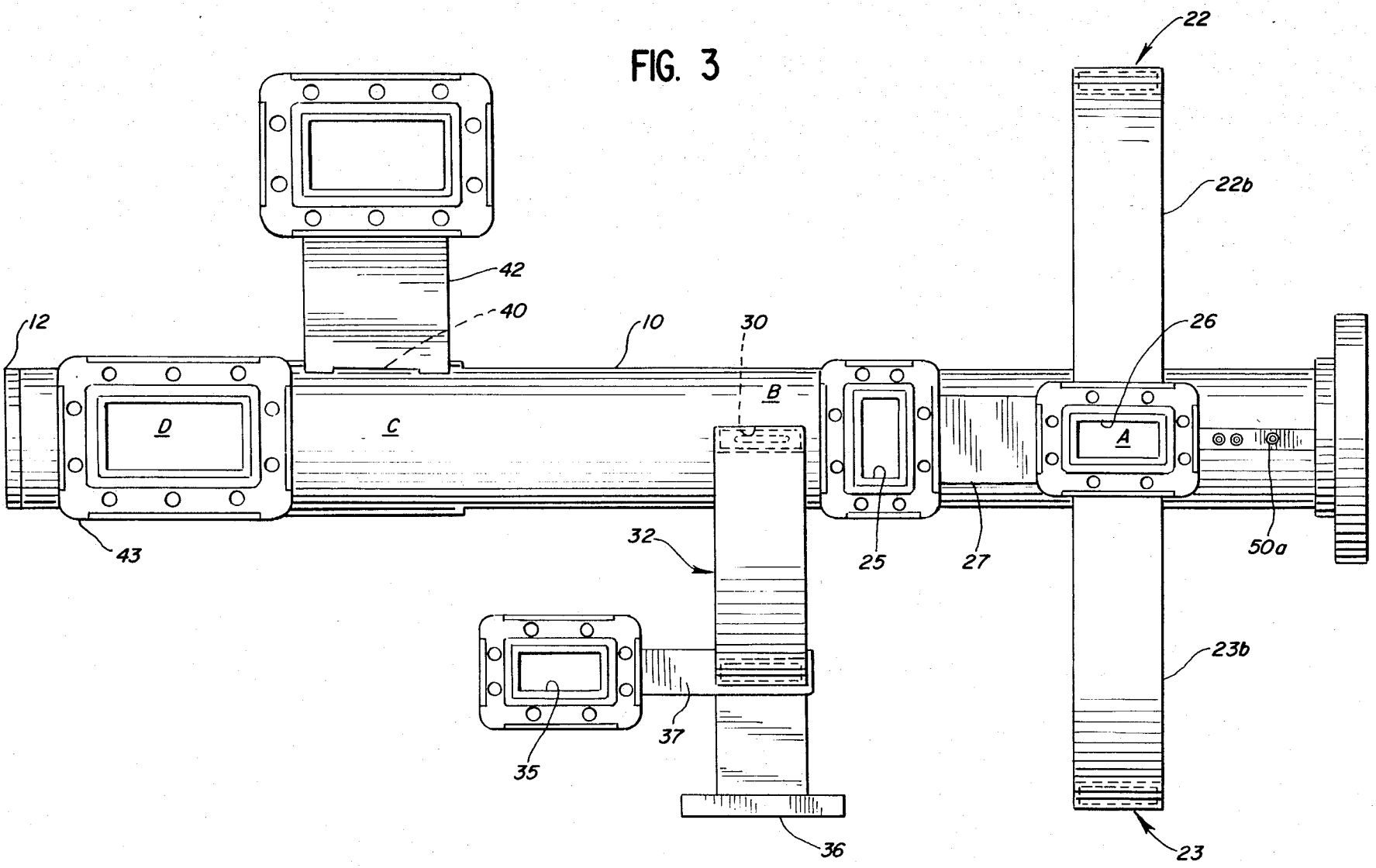
FIG. 3 is a top plan view of the combiner as illustrated in FIG. 1, taken generally along the line 3—3 in FIG. 2.

While the invention has been shown and will be described in some detail with reference to specific exemplary embodiments, there is no intention that the invention be limited to these particular embodiments. On the contrary, it is intended to cover all modifications, alternatives and equivalents which may fall within the spirit and scope of the invention as defined by the appended claims.

Turning now to the drawings and referring first to FIGS. 1 through 15, there is shown a four-port combiner having a main waveguide 10 with an open end or mouth 11 through which signals are transmitted to and from four junctions A, B, C and D. The other end of the combiner is closed by a cap 12 having a conventional shorting plate or termination load 12*a* on its inner surface (see FIG. 13). The main central waveguide 10 of the illustrative combiner has a circular cross-section, and the four junctions A, B, C and D are spaced along the length thereof for transmitting and receiving two pairs of co-polarized signals in two different frequency bands. Junctions A and C are longitudinally aligned with each other for receiving one pair of co-polar signals, and junctions B and D are similarly aligned for receiving the other pair of co-polar signals. One of the junctions in each aligned pair, namely junction A in one pair and junction B in the other pair, is dimensioned to transmit and receive signals in the higher frequency band, while the other two junctions C and D are dimensioned to transmit and receive signals in the lower frequency band. For example, in a typical application junctions A and B handle orthogonally polarized signals in the 6-GHz frequency band (5.925 to 6.425 GHz), and junctions C and D handle orthogonally polarized signals in the 4-GHz frequency band (3.7 to 4.2 GHz). The microwave signals can be transmitted in one of these frequency bands and received in the other frequency band, or the signals can be simultaneously transmitted and received in both frequency bands and both polarizations.

Figure 4:
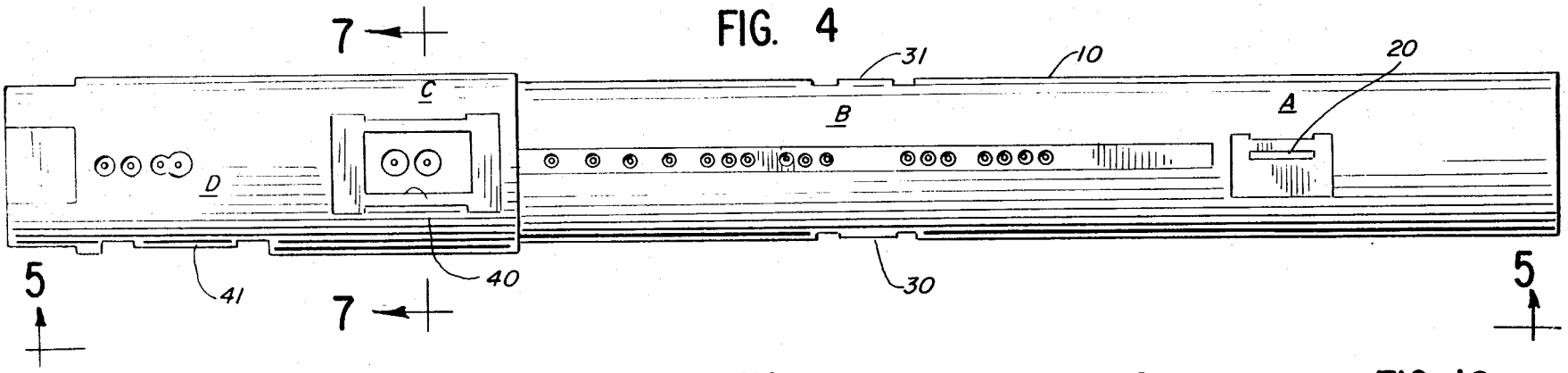
FIG. 4 is a front elevation of the main waveguide in the combiner as shown in FIG. 2.
Figure 10:
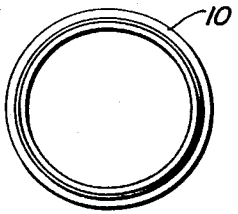
FIG. 10 is an end elevation taken generally along line 10—10 in FIG. 5.
Figure 9:
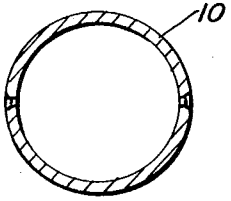
FIG. 9 is a section taken generally along line 9—9 in FIG. 5.
Figure 8:
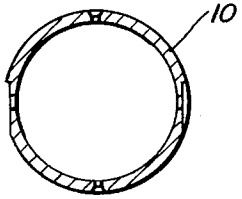
FIG. 8 is a section taken generally along line 8—8 in FIG. 5.
Figure 7:
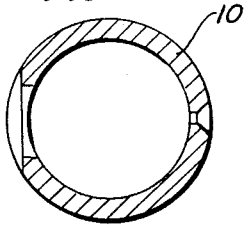
FIG. 7 is a section taken generally along line 7—7 in FIG. 4.
Figure 6:
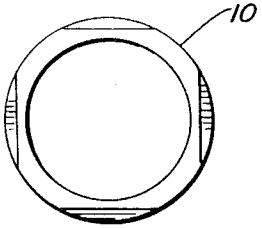
FIG. 6 is an end elevation taken generally along line 6—6 in FIG. 5.
Figure 5:
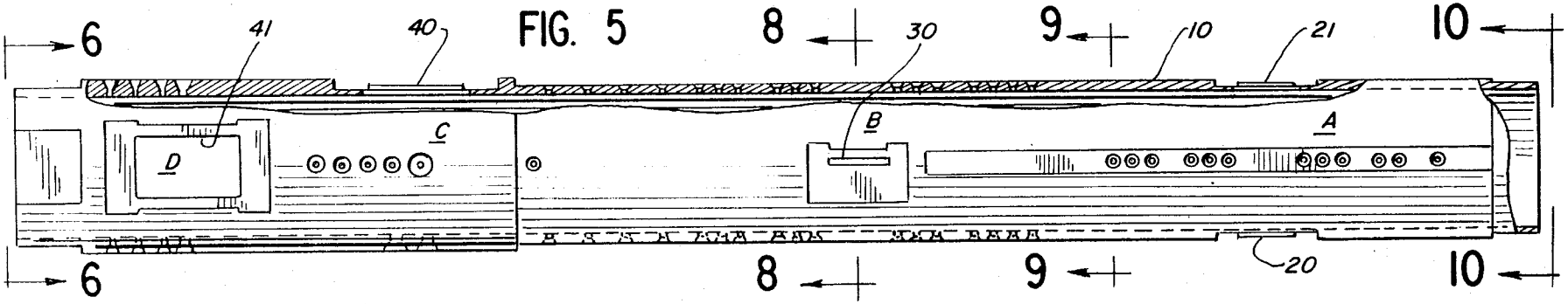
FIG. 5 is an elevation taken generally along line 5—5 in FIG. 4, partially in section.
Figure 11:
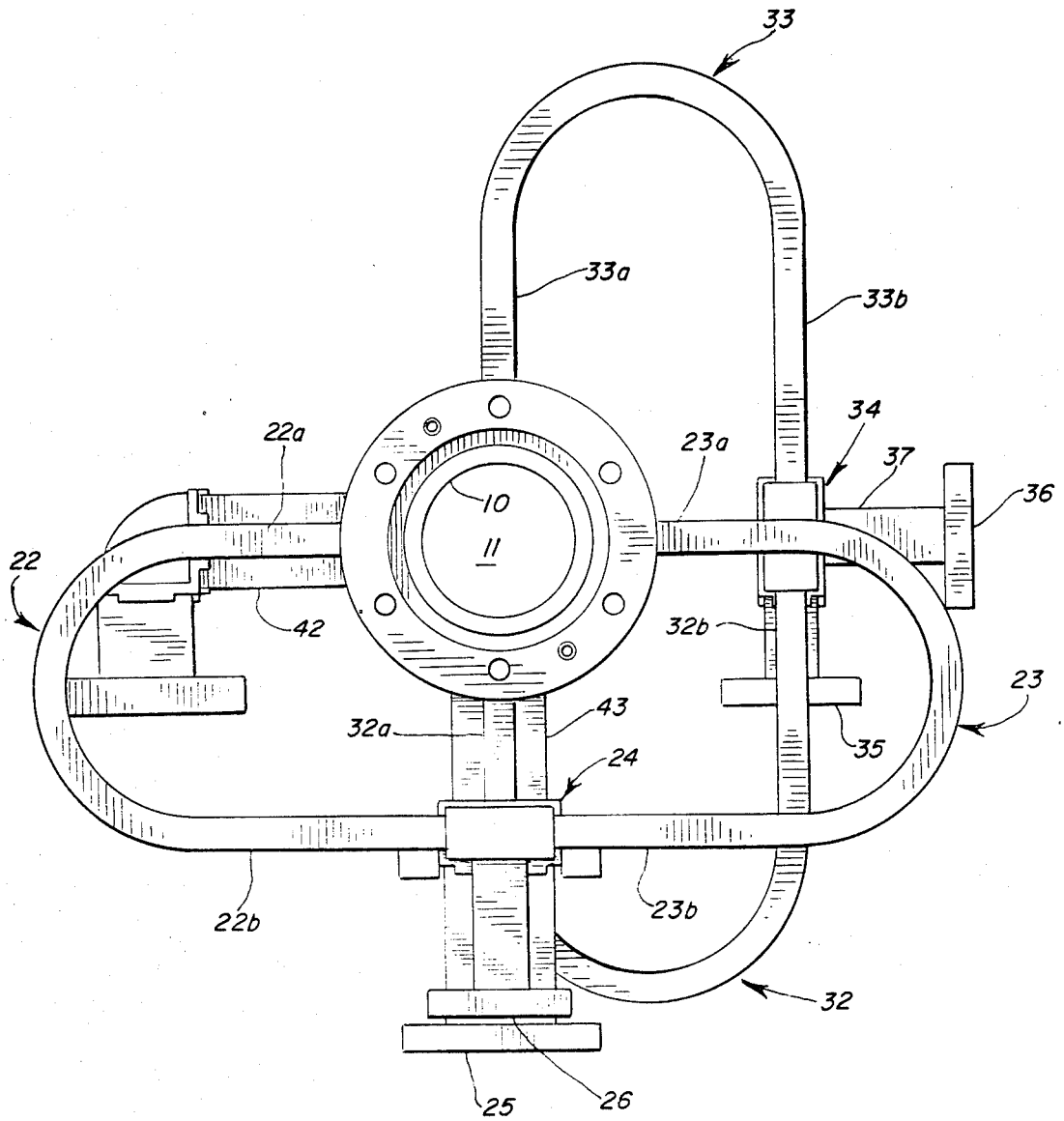
FIG. 11 is an end elevation of the combiner taken from the right-hand end in FIG. 2.

As can be seen most clearly in FIGS. 4 and 5, the irises which are formed in the wall of the circular waveguide 10 to define the locations of the four junctions A through D have rectangular configurations, and each of these irises is connected to a corresponding side-arm waveguide of rectangular cross-section. Each of the two high-frequency junctions A and B includes a pair of diametrically opposed irises to form a balanced coupling between the main waveguide 10 and the side-arm waveguides at these junctions. The rectangular irises at all four junctions have their long (H-plane) dimensions extending in the longitudinal direction, i.e., parallel to the axis of the main circular waveguide 10.

Examining junction A in more detail, the two diametrically opposed irises 20 and 21 at this junction are connected to a pair of U-shaped rectangular waveguides 22 and 23 with the open ends of the U's aligned with each other. One pair of adjacent legs 22*a*, 23*a* of the U-shaped side-arm waveguides 22, 23 are connected to the main waveguide 10, in register with the irises 20 and 21, and the other pair of adjacent legs 22*b*, 23*b* are connected to opposite sides of a hybrid tee 24. In the particular embodiment illustrated, the side-arm waveguides 22 and 23 are "half-height" waveguide, i.e., the E-plane dimension is half the normal E-plane dimension of rectangular waveguide. The narrow E-plane dimension of the "half-height" waveguide reduces the minimum radius of the U bends in the side arms 22 and 23 and also reduces the required E-plane dimension of the associated irises 20 and 21, which in turn improves the isolation between the two 6-GHz junctions A and B and reduces the 4-GHz VSWR. As can be seen most clearly in FIG. 14, a plurality of tuning screws 28*a–d* and 29*a–d* are provided in the respective side arms 22 and 23 to facilitate the tuning and balancing of junction A.

The hybrid tee 24 is a well known waveguide connection having both an in-phase port 25 and an out-of-phase port 26 in the main waveguide 27 of the T (the hybrid tee configuration provides excellent isolation between the two ports). The two top branches of the T are formed by the adjacent legs of the U-shaped side arms 22 and 23 which lead into a pair of rectangular apertures on opposite sides of the main waveguide 27 of the tee. During normal operation, signals are passed through the in-phase port 26, and the out-of-phase port 26 is covered with a load plate (not shown) having a conventional termination load on its inner surface or simply a shorting cover plate.

The structure of junction B is similar to that of junction A, except that everything is rotated 90° around the axis of the main circular waveguide 10. Thus, junction B has two diametrically opposed irises 30 and 31 connected to a pair of U-shaped rectangular waveguides 32 and 33 having one pair of adjacent legs 32*a*, 33*a* connected to the main waveguide 10, in register with the irises 30 and 31, and the other pair of adjacent legs 32*b*, 33*b* connected to opposite sides of a hybrid tee 34. As in the case of the side-arm waveguides at junction A, the side-arm waveguides 32 and 33 of junction B are made of "half-height" waveguides and are provided with tuning screws 38*a–d* and 39*a–d*. The hybrid tee 34 has an in-phase port 35 and an out-of-phase port 36 in the main waveguide 37 of the tee, and the two top branches of the tee are formed by the adjacent legs 32*b*, 33*b* of the side arms 32 and 33 leading into a pair of rectangular apertures on opposite sides of the main waveguide 37. The out-of-phase of port 36 is covered with short or a load plate (not shown) during normal operation, with the microwave signals being passed through the in-phase junction 35.

Turning next to the low-frequency junctions C and D, each of these junctions has only a single rectangular iris 40 or 41 connected to a single rectangular side-arm waveguide 42 or 43. The rectangular waveguide used to form the side arms 42 and 43 is normal waveguide rather than the "half-height" waveguide used at junctions A and B.

In accordance with one important aspect of the present invention, one or both of the high frequency junctions are located in the front section of the main waveguide, which is necessarily overmoded to permit the propagation of both the low frequency and high frequency signals therethrough, and filtering means are disposed within the overmoded portion of the main waveguide to couple the high frequency signals into irises and side arms of the high frequency junctions and to pass the low frequency signals past the irises of the high frequency junctions. More particularly, the filtering means associated with each high frequency junction has a stopband characteristic for coupling the high frequency signals between the main waveguide and the high-frequency irises and side arms, and a passband characteristic for passing low-frequency signals past the irises of the high-frequency junction. In addition, the filtering means and the geometry of the high-frequency junction suppress spurious excitation of signals in undesired propagation modes different from the mode in which the desired signals are being propagated.

No filters are required in any of the side arms in the combiner of this invention (though side-arm filters may be added as optional features if desired). The fact that the high frequency irises and side arms are dimensioned to support only the high frequency signals means that these irises and side arms themselves serve to filter out any low frequency signals, and thus no supplemental filters are required in the high frequency side arms. At the low frequency junctions, the high frequency signals are not present, and thus here again there is no need for any filters in the side arms.

In the particular embodiment illustrated, the filtering network associated with the first 6-GHz junction (junction A) takes the form of two diametrically opposed rows of conductive posts 50*a–o* and 51*a–o* extending into the main waveguide 10 along a diametral plane located midway between the the two irises 20 and 21. These two rows of posts 50 and 51 form a balanced filter which presents symmetrical discontinuities to the signals polarized with junctions A and C, and which is virtually invisible to the orthogonally polarized signals of junctions B and D. This filter has a stopband characteristic which couples one of the two orthogonally polarized 6-GHz signals into the side arms 22 and 23 of junction A, and a passband characteristic which allows the co-polarized 4-GHz signal to pass junction A unimpeded. Both the 4-GHz and the 6-GHz signals that are orthogonally polarized relative to the 6-GHz signal coupled to junction A pass the junction-A filter unimpeded.

Although all the posts 50 and 51 are mutually coupled, different sub-groups of these posts have their primary influence on different properties of the combiner. Thus, the longitudinal locations and radial lengths of posts 50*a–c* and 51*a–c* are most critical to the 6-GHz VSWR, while the lengths of these posts are important to the 4-GHz VSWR. The locations and lengths of posts 50*d–i* and 51*d–i* are selected to achieve optimum 6-GHz VSWR, but in a combination which does not degrade the 4-GHz VSWR; the lengths of posts 50*d–f*, 50*h*, 51*d–f* and 51*h* particularly influence the 4-GHz VSWR. Posts 50*g–i* and 51*g–i* are set to direct the 6-GHz signal from the side arms 22 and 23 toward posts 50*a* and 51*a*, thus setting a basic high frequency isolation level. Isolation of the 6-GHz signal from the direction of posts 50*o* and 51*o* is controlled by the locations and lengths of posts 50*j–n* and 51*j–n*, which also have a strong effect on the 4-GHz VSWR. Posts 50*o* and 51*o* affect mainly the 4-GHz VSWR.

As implied by the foregoing discussion, the performance of the filter formed by posts 50 and 51 is evaluated primarily in terms of the 4-GHz VSWR (measured from behind posts 50*o* and 51*o*), the 6-GHz VSWR (meaured from the junction A side arms 22 and 23), and the 6-GHz isolation (signal level measured from behind posts 50*o* and 51*o*). The particular filter illustrated in FIG. 4 is only one example of a configuration that has been found to produce good results in a four-junction combiner for orthogonally polarized 4 and 6 GHz signals; it will be understood that other configurations will produce similar results for the same or different frequency bands and/or for different waveguide configurations. Similarly, the posts 50 and 51, which in the illustrative embodiment are in the form of screws for easy adjustment of radial length, may be replaced by balanced vanes, fins, rods, pins or other tunable devices.

The filtering network associated with the second 6-GHz junction (junction B) is formed by two diametrically opposed rows of conductive posts 60*a–q* and 61*a–q* extending into the main waveguide 10 along a diametral plane located midway between the two irises 30 and 31. The filter formed by these two rows of posts 60 and 61 is essentially the same as the filter formed by the two rows of posts 50 and 51 at junction A, as described above, except that the filter associated with junction B is displaced 90° around the axis of the waveguide 10 from the filter of junction A. Also, the filter of junction B has two additional pairs of posts, namely posts 60*b*, 61*b* and 60*q*, 61*q*, and the spacing and radial lengths of the posts 60 and 61 differ slightly from the locations and lengths of the posts 50 and 51 at junction A. Both filters have similar stopband and passband characteristics, i.e., the filter formed at junction B by the two rows of posts 60 and 61 has a stopband characteristic which couples one of the two orthogonally polarized 6-GHz signals into the side arms 32 and 33 of junction A, and a passband characteristic which allows the co-polarized 4-GHz signal to pass junction B unimpeded. The junction-B filter also permits unimpeded passage of signals that are orthogonally polarized relative to the 6-GHz signal that is coupled into the side arms 32 and 33 of junction B, regardless of the frequency of such orthogonally polarized signals.

The section of the main waveguide 10 containing the two low-frequency junctions C and D is no longer overmoded because only the 4-GHz signals are propagated through this section of the waveguide. In order to couple one of the orthogonally polarized 4-GHz signals from the main waveguide 10 into the irises and side arms of junction C, two pairs of diametrically opposed posts 70*a*, 71*a* and 70*b*, 71*b* and a single row of pins 72 extend into the main waveguide 10 along a diametral plane displaced 90° from a diametral plane passing through the center of the iris 40 of junction C. The posts 70*a–b* and 71*a–b* and the iris 40 form a matched impedance, and the pins 72 form a shorting device. In addition, a pair of tuning posts 73*a*, 73*b* are located opposite the iris 40 to balance the impedance introduced by the iris so that the orthogonally polarized 4-GHz signal passes junction C unimpeded. Similar posts 80*a–b* and pins 81, displaced 90° around the axis of the main waveguide 10 from the posts and pins of junction C, couple the other 4-GHz signal into the low-frequency junction D.

One of the important features of the combiner of this invention is that it avoids spurious excitation of unacceptable levels of unwanted higher order modes of the 4 and 6 GHz signals within the overmoded portion of the main waveguide. This is accomplished by the waveguide geometry in combination with the use of tunable filter devices which either (1) do not excite unwanted modes or (2) excite equal levels of such modes 180° out of phase with each other so that they effectively cancel each other. In the illustrative embodiment, the combination feed system for a 4-GHz, 6-GHz antenna which is mis-aligned, the combiner will receive low-level 6-GHz, $TE_{21}$-mode signals from the antenna. These signals will be coupled into the corresponding 6-GHz side arms at junctions A and B and propagated therethrough in the dominant $TE_{10}$ mode, but with a phase difference of 180° between the signals in the two side arms of each junction. In normal operation, these signals propagate on through the hybrid tee and the rest of the system with very little perturbing effect on the desired signal, i.e., the signal that originates in the $TE_{11}$ mode in the main waveguide and is coupled into the two side arms with essentially no phase difference.

When it is desired to use the $TE_{21}$-mode signal to correct antenna mis-alignment, the load plate is removed from the out-of-phase junction 26 of the hybrid tee 24 so that the out-of-phase energy from the two side arms 22 and 23 can be monitored by connecting conventional signal-monitoring equipment to the junction 26. The radiation pattern produced by the $TE_{21}$ mode is a symmetrical four-lobe pattern in which the lobes on opposite sides of the central axis have opposite polarities; thus, the signal level monitored at the out-of-phase port of the hybrid tee will be at a minimum when the antenna is perfectly aligned. This alignment technique, using the $TE_{21}$ mode null on boresight axis, is much more precise than alignment techniques using the dominant $TE_{11}$ mode, which produces a radiation pattern with a single on-axis lobe.

To align the antenna in both azimuth and elevation, the signals derived from the $TE_{21}$ mode in the main waveguide must be monitored at either port 26 of hybrid tee 24 or port 36 of hybrid tee 34. When a horizontally polarized incoming signal is being monitored at port 26 or 36, the antenna is adjusted in elevation until the monitored signal level is minimized. When a vertically polarized signal is being received, the antenna is adjusted in azimuth until the signal level at port 26 or 36 is minimized. While these fine adjustments are being made, the antenna system remains fully functional because the $TE_{11}$ and $TE_{21}$ signals are mutually orthogonal and, therefore, do not interfere with each other. As a result, the antenna can be precisely aligned while "in traffic".

Figure 12:
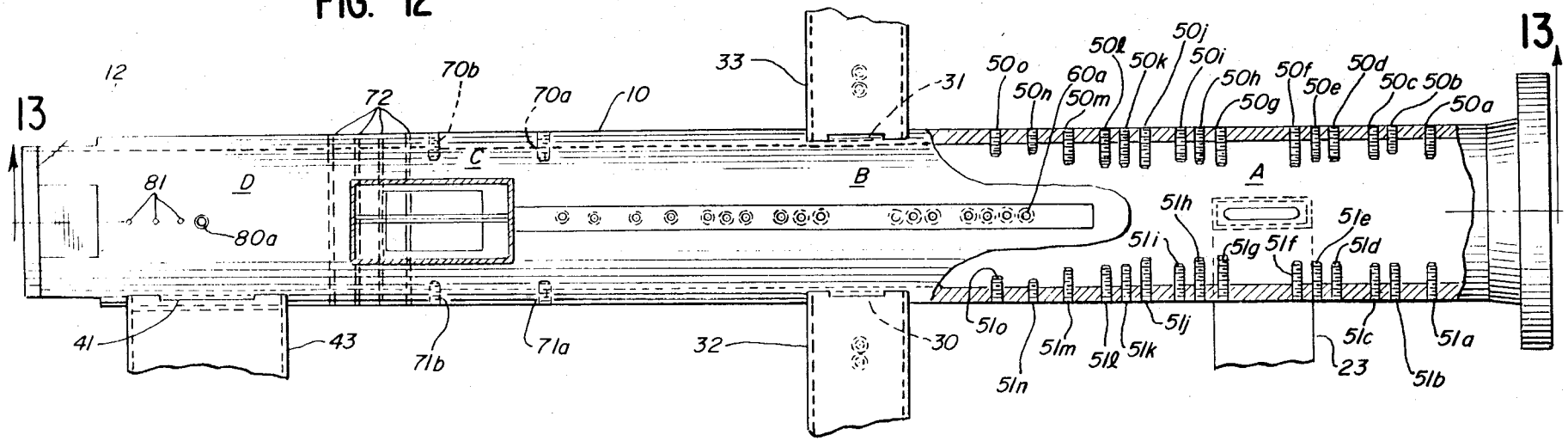
FIG. 12 is a slightly modified front elevation similar to FIG. 2 but showing much of the internal structure in broken lines or by partial sectioning.
Figure 13:
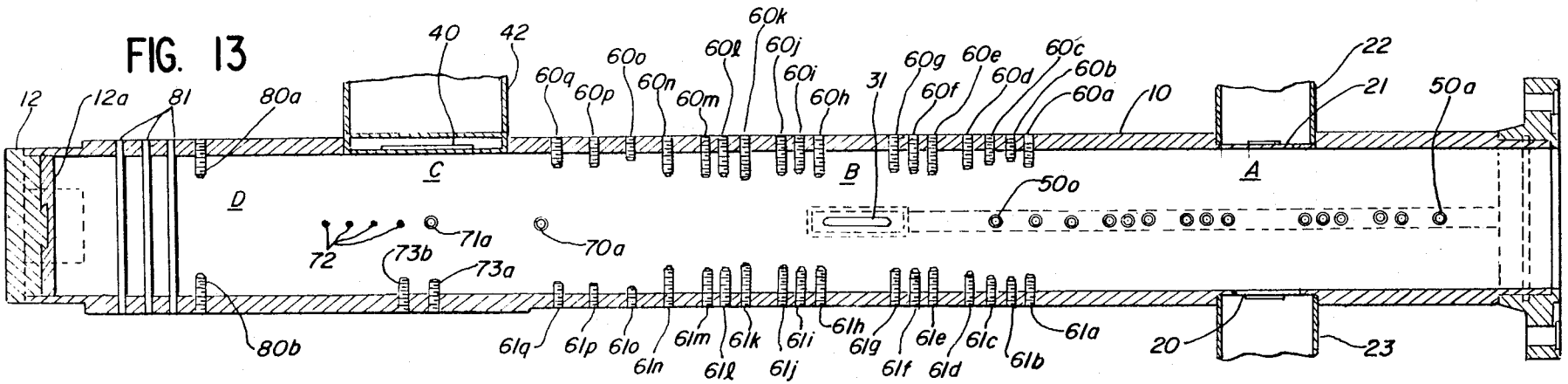
FIG. 13 is a section taken generally along line 13—13 in FIG. 12.
Figure 14:
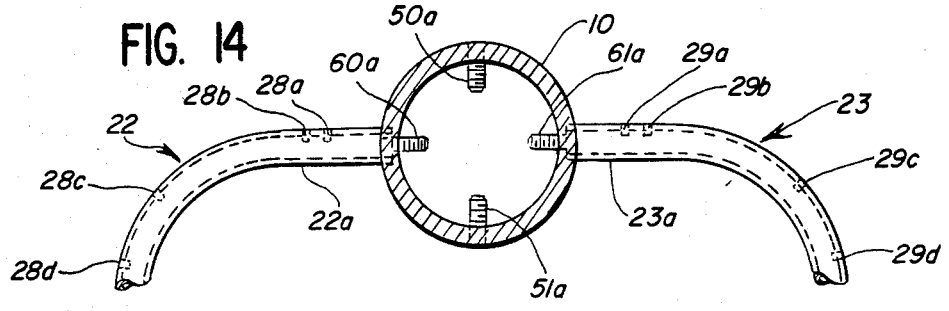
FIG. 14 is a section taken generally along line 14—14 in FIG. 2.
Figure 15:
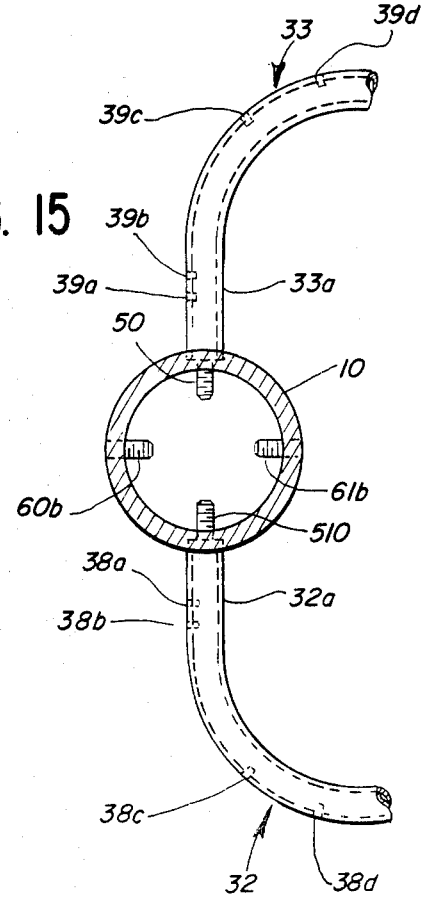
FIG. 15 is a section taken generally along line 15—15 in FIG. 2.

The particular combiner described above produces excellent performance characteristics when used to transmit and receive signals in the 4 and 6 GHz frequency bands, i.e., in the frequency bands of 3.7 to 4.2 GHz and 5.925 to 6.425 GHz. In particular, this combiner exhibits low VSWR, low insertion losses, and a high degree of isolation among ports, frequency bands, and polarization planes. One specific example of such a combiner was made of brass with a main waveguide of circular cross section, 22.75" long, and a 2.125" inside diameter. The two 6-GHz junctions had 0.975"×0.12" rectangular irises located 4.136" and 10.166" from the open end, and the 6-GHz side arms were WR137 half-height rectangular waveguide. The two 4-GHz junctions had 1.568"×0.95" rectangular irises located 16.555" and 10.931" from the open end, and the 4-GHZ side arms were WR229 rectangular waveguide. The locations and lengths of the posts forming the filters were as shown in FIGS. 12 and 13. In Starr, *Radio and Radar Technique*, Sir Isaac Pitman & Sons, LTD., London, 1953, pp. 126–133, the author discusses the electrical characteristics of discontinuities in waveguides, and specifically describes the impedance of posts having a particular diameter, depth of waveguide penetration, and length. Further, in Harvey, *Microwave Engineering*, Academic Press, New York, 1963, pp. 214–219, the author discloses the use of posts in the construction of a pass-band filter. In Snyder, "New Application Of Evanescent Mode Waveguide To Filter Design," *IEEE MTT-S Int'l Micro. Sym. Digest,* 1977, pp. 294–297, the author describes the use of a technique for designing multi-post filters in rectangular waveguides, and applies the technique in developing a passband filter with a circular cross-section using posts.

In a test using orthogonally polarized signals (each signal being linearly polarized) in each of two frequency bands extending from 3.690 to 4.210 GHz and from 5.915 to 6.435 GHz, this combiner produced the following results:

VSWR: 1.045 Maximum—all four ports
Isolation Between Bands: 35 dB Minimum
Maximum Higher Order Mode Level: 30 dB Minimum Below Desired Mode Level
Polarization Isolation: 40 dB Minimum (45 dB at 4 GHz and 52 dB at 6 GHz)
Insertion Loss: 0.4 dB Maximum at 6 GHz, 0.15 dB Maximum at 4 GHz While the invention has been described above with particular reference to an exemplary four-post combiner, it will be appreciated that the invention is applicable to a large number of different combiner configurations having two or more longitudinally spaced junctions for handling signals in two or more different frequency bands. The signals in one or all of the different frequency bands may be orthogonally polarized, and the orthogonally polarized signals can be either linearly polarized or circularly polarized. Circular polarization is implemented by the addition of polarizers in the main waveguide.

At junctions where a purely balanced feed is not required, a pseudo-balanced feed may be used to improve impedance matching and reduce the VSWR of the combiner. A pseudo-balanced feed has two diametrically opposed irises on opposite sides of the main waveguide, but only one of these irises is coupled to a true side-arm waveguide for propagating the desired signals. The other iris is coupled to a stub waveguide which can be tuned to produce the desired impedance matching.

Figure 16:
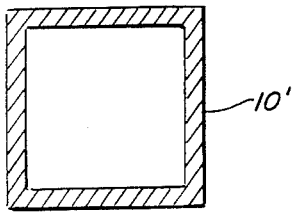
FIG. 16 is a section taken through the main waveguide of a modified combiner similar to that shown in FIG. 1 but having a main waveguide of square cross section.
Figure 17:
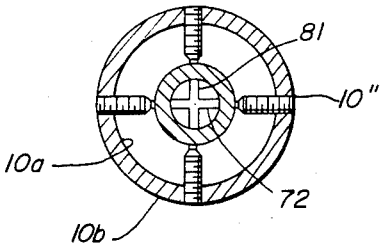
FIG. 17 is a section taken through the main waveguide of another modified combiner similar to that shown in FIG. 1 but having a main waveguide of coaxial cross section.
Figure 18:
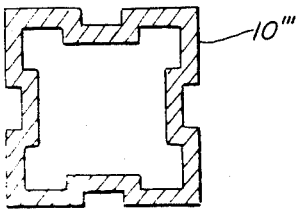
FIG. 18 is a section taken through the main waveguide of a further modified combiner similar to that shown in FIG. 1 but having a main waveguide of quadruply ridged cross section.

As illustrated in FIGS. 16–18, the main waveguide 10 can also be modified to have different cross-sectional configurations. FIG. 16 illustrates a main waveguide 10' having a square cross section; FIG. 17 illustrates a main waveguide 10'' having a coaxial cross section with spaced inner and outer conductors 10*a* and 10*b*; and FIG. 18 illustrates a main waveguide 10''' having quadruply ridged square waveguide. Another possible configuration is quadruply ridged circular waveguide. Yet another possible cross-sectional configuration for the main waveguide 10 is rectangular, which would be used primarily in combiners for handling signals having different frequencies but all having the same polarization. When the main waveguide has a cross-sectional configuration other than circular, it is generally desired to have a transition to a circular cross section at the open end of the main waveguide, such as a square main waveguide merging into a circular flared horn, for example.

Figure 19:
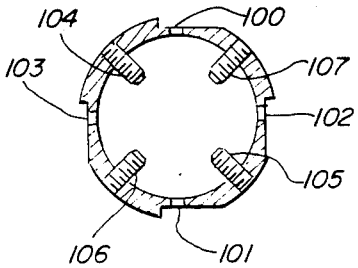
FIG. 19 is a section taken through a combiner similar to that illustrated in FIG. 1 but having the two high frequency junctions located at the same longitudinal position.

It should also be noted that the two orthogonally polarized junctions for any given frequency band can be located at the same longitudinal position, as illustrated in FIG. 19. In this configuration two pairs of diametrically opposed irises 100, 101 and 102, 103 form a pair of mutually perpendicular, balanced feed ports for handling two orthogonally polarized signals of the same frequency at the same longitudinal location in the main waveguide. The conductive posts which form the filtering means in this configuration are located on diametral planes extending across the circular waveguide midway between adjacent pairs of irises. Thus, two rows of filter posts 104 and 105 are located midway between adjacent iris pairs 100, 103 and 101, 102, and another two rows of filter posts 106 and 107 are located midway between adjacent iris pairs 101, 103 and 100, 102. It can be seen that the conductor posts which form the filters in this configuration are displaced only 45°, rather than 90°, from the adjacent irises.

Figure 20:
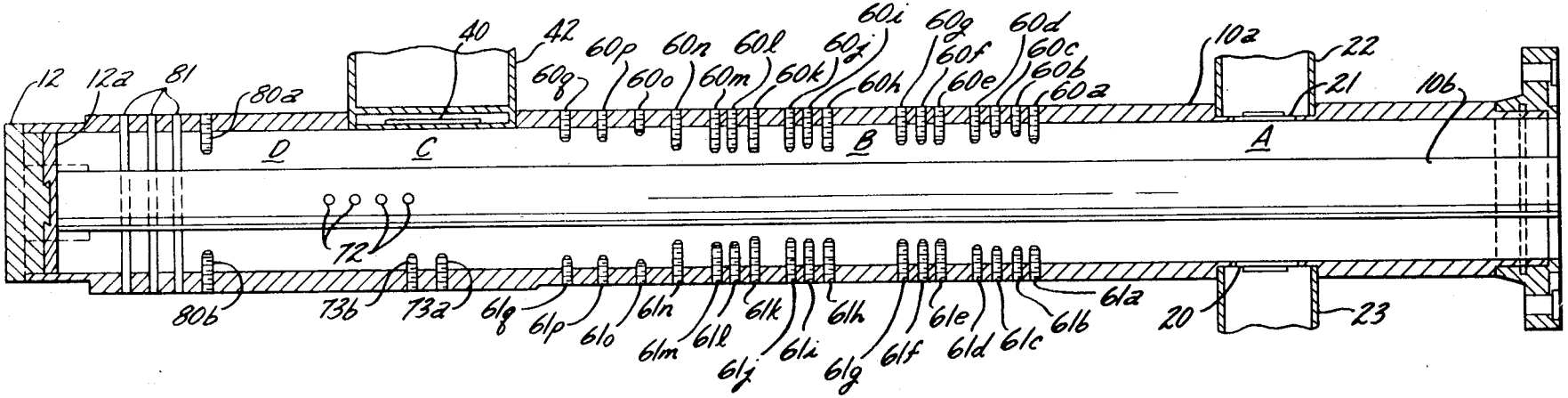
FIG. 20 is a longitudinal section similar to FIG. 13 but showing the embodiment of FIG. 17, which utilizes a coaxial main waveguide.

As illustrated in FIG. 20, the locations and lengths of the posts forming the filters in the embodiment which utilizes the coaxial main waveguide are the same as those shown in FIG. 13 for the circular main waveguide embodiment.

As can be seen from the foregoing detailed description, this invention provides an improved combiner than can be economically manufactured and yet provides excellent performance characteristics. The combiner can be made with a compact size and relatively simple geometry, and yet it offers low insertion losses, low VSWR, and a high degree of isolation among ports, frequency bands, and polarizations, even when the frequency bands have widths of 500 MHz or more. This combiner does not require any filters in the side arms (although such filters can be used as optional features if desired), and yet prevents the spurious excitation of unacceptable levels of unwanted higher order modes of the desired signals. Furthermore, this combiner greatly facilitates correction of antenna misalignment, both during original installation and in subsequent re-alignment operations, permitting an antenna to be precisely aligned without removing it from service.

We claim as our invention:

1. A combiner for transmitting and receiving co-polarized microwave signals in a selected propagation mode in at least first higher and second lower frequency bands, said combiner comprising a main waveguide dimensioned to simultaneously propagate signals in said different frequency bands, at least a portion of said main waveguide being overmoded, first and second junctions spaced along the length of said main waveguide for coupling signals in said different frequency bands in and out of said main waveguide, at least said first junction being located in an overmoded portion of said main waveguide and having side-arm waveguide means associated therewith, said first junction and said side-arm waveguide means being dimensioned to propagate signals in said first frequency band, filtering means disposed within said main waveguide and having (1) a stopband characteristic for coupling signals in said first frequency band between said main waveguide and said first junction and said side-arm waveguide means associated therewith, and (2) a passband characteristic for passing signals in said second frequency band past said first junction, said filtering means longitudinally overlapping said first junction and being aligned with a longitudinal plane that is orthogonal to a longitudinal plane passing through said first junction, said filtering means and said first junction suppressing spurious excitation of signals in undesired propagation modes different from said selected mode, and means for coupling signals in said second frequency band between said main waveguide and said second junction.

2. A combiner as set forth in claim 1 wherein said second junction includes side-arm waveguide means, and said means for coupling signals in said second frequency band comprises filtering means having a stopband characteristic for coupling signals in said second frequency band between said main waveguide and said second junction and the side-arm waveguide means associated therewith.

3. A combiner as set forth in claim 1 wherein said first and second junctions are in longitudinal alignment with each other, and which includes at least a third junction spaced longitudinally from said first and second junctions and located 90° away from said first and second junctions around the axis of said main waveguide, for propagating signals orthogonally polarized relative to the signals propagated through said first and second junctions, side-arm waveguide means associated with said third junction, and means for coupling said orthogonally polarized signals between said main waveguide and said third junction and the side-arm waveguide means associated therewith.

4. A combiner as set forth in claim 1 wherein said filtering means comprises conductive elements extending into said main waveguide along a diametral plane perpendicular to a diametral plane passing through the middle of the side-arm waveguide means of the associated junction.

5. A combiner as set forth in claim 1 wherein at least said first junction comprises a pair of diametrically opposed irises in the walls of said main waveguide, and side-arm waveguides connected to said irises to form a balanced coupling to said main waveguide at said first junction.

6. A combiner as set forth in claim 5 wherein said side-arm waveguides associated with said pair of irises at said first or second junction are both coupled to a hybrid tee having an in-phase port and an out-of-phase port, whereby said out-of-phase port can be used to transmit and receive a selected higher mode signal through said first or second junction for use in aligning an antenna associated with said combiner.

7. A combiner as set forth in claim 1 wherein said main waveguide has a circular cross-section and said side-arm waveguide means have rectangular cross-sections.

8. A combiner as set forth in claim 1 wherein said main waveguide has a square cross section.

9. A combiner as set forth in claim 1 wherein said main waveguide is a coaxial waveguide having inner and outer conductors spaced from each other and having circular cross sections.

10. A combiner as set forth in claim 1 wherein said main waveguide is a quadruply ridged waveguide.

11. A combiner as set forth in claim 1 wherein said first junction comprises two pairs of diametrically opposed irises in the walls of said main waveguide, and two pairs of side-arm waveguides connected to said irises to form a pair of mutually perpendicular, balanced couplings to said main waveguide at said first junction; and wherein said filtering means comprises conductive elements extending into said main waveguide at diametrically opposed locations midway between adjacent pairs of said irises.

12. A combiner as set forth in claim 1 wherein said main waveguide has a substantially uniform cross section along the entire length of said main waveguide.

13. A combiner for transmitting and receiving signals in at least first higher and second lower frequency bands in each of at least two different polarization planes, said combiner comprising a main waveguide which is dimensioned to simultaneously propagate signals in said different frequency bands, at least a portion of said main waveguide being overmoded, said main waveguide having first and second junctions spaced along the length thereof for coupling co-polarized signals having different frequencies in and out of said main waveguide, and filtering means disposed within said main waveguide and (1) having both stopband and passband characteristics for blocking said signals aligned with said first and second junctions in said first frequency band and passing such signals in said second frequency band, (2) permitting unimpeded passage through said waveguide of signals that are orthogonally polarized relative to said first and second junctions, and (3) suppressing spurious excitation of signals in undesired propagation modes that would interfere with the desired signals being propagated through said combiner, said filtering means longitudinally overlapping said first junction and being aligned with a longitudinal plane that is orthogonal to a longitudinal plane passing through said first junction.

14. A combiner as set forth in claim 13 wherein at least the junction for coupling the highest frequency signal is located in the overmoded portion of said main waveguide.

15. A combiner as set forth in claim 14 which includes two pairs of said first and second junctions, one pair being rotated 90° from the other pair relative to the axis of said main waveguide.

16. A combiner as set forth in claim 13 wherein said filtering means comprises a plurality of conductive elements projecting inwardly from diametrically opposed locations on the internal walls of said main waveguide in the vicinity of said first junction.

17. A combiner as set forth in claim 13 wherein said main waveguide has at least four junctions spaced along the length thereof, two of said junctions being located in the overmoded portion of said main waveguide and being dimensioned and positioned to propagate orthogonally polarized signals in said first frequency band, and the filtering means associated with said two junctions blocking the transmission of said higher frequency signals and passing orthogonally polarized signals in said second frequency band for propagation via the other two junctions.

18. A combiner as set forth in claim 13 wherein said main waveguide has a substantially uniform cross section along the entire length of said main waveguide.

19. A method of transmitting and receiving co-polarized microwave signals in a selected propagation mode in at least first higher and second lower frequency bands, said method comprising the steps of simultaneously propagating signals in said different frequency bands through a main waveguide, at least a portion of said main waveguide being overmoded, propagating signals in said different frequency bands through first and second junctions spaced along the length of said main waveguide, at least said first junction being located in an overmoded portion of said main waveguide and having side-arm waveguide means associated therewith for propagating signals in said first frequency band, coupling signals in said first frequency band between said main waveguide and said first junction and the side-arm waveguide means associated therewith while passing signals in said second frequency band past said first junction, the coupling of said signals between said main waveguide and said first junction being effected by filtering means which suppresses spurious excitation of signals in undesired propagation modes different from said selected mode, said filtering means longitudinally overlapping said first junction and being aligned with a longitudinal plane that is orthogonal to a longitudinal plane passing through said first junction, coupling signals in said second frequency band between said main waveguide and said second junction.

20. A method as set forth in claim 19 wherein said second junction includes side-arm waveguide means, and the coupling of said signals in said second frequency band is effected by filtering means having a stopband characteristic for coupling signals in said second frequency band between said main waveguide and said second junction and the side-arm waveguide means associated therewith.

21. A method as set forth in claim 19 wherein said first and second junctions are in longitudinal alignment with each other, signals orthogonally polarized relative to the signals propagated through said first and second junctions are propagated through a third junction spaced longitudinally from said first and second junctions and located 90° away from said first and second junctions around the axis of said main waveguide, and said orthogonally polarized signals are coupled between said main waveguide and said third junction and the side-arm waveguide means associated therewith.

22. A method as set forth in claim 19 wherein said filtering means comprises conductive elements extending into said main waveguide along a diametral plane perpendicular to a diametral plane passing through the middle of the side-arm waveguide means of the associated junction.

23. A method as set forth in claim 19 wherein at least said first junction comprises a pair of diametrically opposed irises in the walls of said main waveguide, and side-arm waveguides connected to said irises to form a balanced coupling to said main waveguide at said first junction.

24. A method as set forth in claim 23 wherein said side-arm waveguides associated with said pair of irises at said first or second junction are both coupled to a hybrid tee having an in-phase port and an out-of-phase port, whereby said out-of-phase port can be used to transmit and receive a selected higher mode signal through said first or second junction for use in aligning an antenna associated with said combiner.

25. A method as set forth in claim 19 wherein said main waveguide has a circular cross-section and said side-arm waveguide means have rectangular cross-sections.

26. A method as set forth in claim 19 wherein said main waveguide has a square cross section.

27. A method as set forth in claim 19 wherein said main waveguide is a coaxial waveguide having inner and outer conductors spaced from each other and having circular cross sections.

28. A method as set forth in claim 19 wherein said main waveguide is a quadruply ridged waveguide.

29. A method for transmitting and receiving signals in at least two different frequency bands in each of at least two different polarization planes, said method comprising the steps of simultaneously propagating signals in said different frequency bands through a main waveguide having a substantially uniform cross section throughout the length of said main waveguide, at least a portion of said main waveguide being overmoded, coupling co-polarized signals having different frequencies in and out of said main waveguide through first and second junctions along the length of said main waveguide, at least said first junction being located in an overmoded portion of said main waveguide, and coupling signals in the higher of said frequency bands in and out of said main waveguide at said first junction while (1) passing signals in the other of said frequency bands past said first junction, (2) permitting unimpeded passage through said main waveguide of signals that are orthogonally polarized relative to said first and second junctions, and (3) suppressing spurious excitation of signals in undesired propagation modes that would interfere with the desired signals being propagated through said main waveguide.

30. A method as set forth in claim 29 wherein at least the junction for the highest frequency signal is located in the overmoded portion of said main waveguide.

31. A method as set forth in claim 29 which includes two pairs of said first and second junctions, one pair being rotated 90° from the other pair relative to the axis of said main waveguide.

32. A method as set forth in claim 29 wherein said coupling of signals in and out of said main waveguide is effected by filtering means comprising a plurality of conductive elements projecting inwardly from diametrically opposed locations on the internal walls of said main waveguide in the vicinity of at least one of said junctions.

33. A method as set forth in claim 29 wherein said main waveguide has at least four junctions spaced along the length thereof, two of said junctions being located in the overmoded portion of said main waveguide and being dimensioned and positioned to propagate orthogonally polarized signals in the higher frequency band.

34. A combiner for transmitting and receiving co-polarized microwave signals in a selected propagation mode in at least two different frequency bands, said combiner comprising a main waveguide dimensioned to simultaneously propagate signals in said different frequency bands, at least a portion of said main waveguide being overmoded, first and second junctions spaced along the length of said main waveguide for coupling signals in said different frequency bands in and out of said main waveguide, at least said first junction being located in an overmoded portion of said main waveguide and having side-arm waveguide means associated therewith for propagating signals in one of said different frequency bands, filtering means disposed within said main waveguide and comprising conductive elements extending into said main waveguide along a diametral plane perpendicular to a diametral plane passing through the middle of the side-arm waveguide means of the junction associated therewith, said filtering means being operatively associated with said first and second junctions and having (1) a stopband characteristic for coupling signals in a first one of said frequency bands between said main waveguide and said first junction and said side-arm waveguide means associated therewith, and (2) a passband characteristic for passing signals in a second one of said frequency bands past said first junction, said filtering means and said first junction suppressing spurious excitation of signals in undesired propagation modes different from said selected mode, and means for coupling signals in said second frequency band between said main waveguide and said second junction.

35. A combiner for transmitting and receiving signals in at least two different frequency bands in each of at least two different polarization planes, said combiner comprising a main waveguide which is dimensioned to simultaneously propagate signals in said different frequency bands, at least a portion of said main waveguide being overmoded, said main waveguide having first and second junctions spaced along the length thereof for coupling co-polarized signals having different frequencies in and out of said main waveguide, and filtering means between said first and second junctions comprising a plurality of conductive elements projecting inwardly from diametrically opposed locations on the internal walls of said main waveguide in the vicinity of at least one of said junctions, said filtering means (1) having both stopband and passband characteristics for blocking said signals aligned with said first and second junctions in one of said frequency bands and passing such signals in the other of said frequency bands, (2) permitting unimpeded passage through said waveguide of signals that are orthogonally polarized relative to said first and second junctions, and (3) suppressing spurious excitation of signals in undesired propagation modes that would interfere with the desired signals being propagated through said combiner.

36. A method of transmitting and receiving co-polarized microwave signals in a selected propagation mode in at least two different frequency bands, said method comprising the steps of simultaneously propagating signals in said different frequency bands through a main waveguide, at least a portion of said main waveguide being overmoded, propagating signals in said different frequency bands through first and second junctions spaced along the length of said main waveguide, at least said first junction being located in an overmoded portion of said main waveguide and having side-arm waveguide means associated therewith for propagating signals in a first one of said different frequency bands, coupling signals in said first frequency band between said main waveguide and said first junction and the side-arm waveguide means associated therewith while passing signals in a second one of said frequency bands past said first junction, the coupling of said signals between said main waveguide and said first junction being effected by filtering means which suppresses spurious excitation of signals in undesired propagation modes different from said selected mode, said filtering means comprising conductive elements extending into said main waveguide along a diametral plane perpendicular to a diametral plane passing through the middle of the side-arm waveguide means of the junction associated therewith, and coupling signals in said second frequency band between said main waveguide and said second junction.

37. A method for transmitting and receiving signals in at least two different frequency bands in each of at least two different polarization planes, said method comprising the steps of simultaneously propagating signals in said different frequency bands through a main waveguide, at least a portion of said main waveguide being overmoded, coupling co-polarized signals having different frequencies in and out of said main waveguide through first and second junctions along the length of said main waveguide, and coupling signals in one of said frequency bands in and out of said main waveguide at said first junction while (1) passing signals in the other of said frequency bands past said first junction, (2) permitting unimpeded passage through said main waveguide of signals that are orthogonally polarized relative to said first and second junctions, and (3) suppressing spurious excitation of signals in undesired propagation modes that would interfere with the desired signals being propagated through said main waveguide, said coupling of signals in and out of said main waveguide being effected by filtering means comprising a plurality of conductive elements projecting inwardly from diametrically opposed locations on the internal walls of said main waveguide in the vicinity of at least one of said junctions.

38. A combiner for transmitting and receiving co-polarized microwave signals in a selected propagation mode in at least first higher and second lower frequency bands, said combiner comprising a main waveguide dimensioned to simultaneously propagate signals in said different frequency bands, one end of said main waveguide being open for launching and receiving all signals propagated therethrough, first and second junctions spaced one from the other along the length of said main waveguide for coupling signals in said different frequency bands in and out of said main waveguide, said first junction being located closer to said open end of said main waveguide and having side-arm waveguide means associated therewith, said first junction and said side-arm waveguide means being dimensioned to transmit and receive signals in said first frequency band, filtering means disposed within said main waveguide with at least a portion of said filtering means angularly spaced from and longitudinally overlapping said first junction, said filtering means having (1) a stopband characteristic for coupling signals in said first frequency band between said main waveguide and said first junction and said side-arm waveguide means associated therewith, and (2) a passband characteristic for passing signals in said second frequency band past said first junction, said filtering means and said first junction suppressing spurious excitation of signals in undesired propagation modes different from said selected mode, and means for coupling signals in said second frequency band between said main waveguide and said second junction.

39. A combiner for transmitting and receiving signals in at least two different frequency bands in each of at least two different polarization planes, said combiner comprising a main waveguide which is dimensioned to simultaneously propagate signals in said different frequency bands, at least a portion of said main waveguide being overmoded, said main waveguide having first, second and third junctions spaced along the length thereof, said first and second junctions coupling orthogonally polarized signals within one of said different frequency bands in and out of said main waveguide and said first and third junctions coupling co-polarized signals within said different frequency bands in and out of said main waveguide, and filtering means disposed between said first and second junctions proximate said first junction and including a plurality of conductive elements extending radially into said main waveguide, said filtering means (1) having both stopband and passband characteristics for blocking said co-polarized signals in one of said different frequency bands and passing such signals in the other of said frequency bands, (2) permitting unimpeded passage through said waveguide of signals that are othogonally polarized relative to said co-polarized signals, and (3) suppressing spurious excitation of signals in undesired propagation modes that would interfere with the desired signals being propagated through said combiner.

40. A combiner for transmitting and receiving signals in at least two different frequency bands in each of at least two different polarization planes, said combiner comprising a main waveguide which is dimensioned to simultaneously propagate signals in said different frequency bands, at least a portion of said main waveguide being overmoded, said main waveguide having first, second, third and fourth junctions spaced one from another along the length thereof, said first and second junctions coupling orthogonally polarized signals in one of said frequency bands in and out of said main waveguide, and said third and fourth junctions coupling orthogonally polarized signals in the other of said frequency bands in and out of said main waveguide, and filtering means disposed proximate said first and second junctions and including a plurality of conductive elements extending radially into said main waveguide, said filtering means (1) having a stopband characteristic for blocking orthogonally polarized signals, said one of said different frequency bands, (2) having a passband characteristic for passing orthogonally polarized signals in the other of said different frequency bands, and (3) suppressing spurious excitation of signals in undesired propagation modes that would interfere with the desired signals being propagated through said combiner.

41. A combiner for transmitting and receiving co-polarized microwave signals in a selected propagation mode in low and high frequency bands, said combiner comprising a main waveguide dimensioned to simultaneously propagate signals in said low and high frequency bands, at least a portion of said main waveguide being overmoded, a pair of high-frequency junctions located in an overmoded portion of said main waveguide and spaced from each other along the length of said main waveguide, said high-frequency junctions also being spaced 90° from each other around the axis of said main waveguide, said high-frequency junctions having sidearm waveguides associated therewith for propagating signals in said high-frequency band, at least one low-frequency junction spaced from said high-frequency junctions along the length of said main waveguide from said high frequency junctions and in longitudinal alignment with one of said high-frequency junctions, filtering means disposed within said main waveguide longitudinally aligned with a first one of said high-frequency junctions and in proximity to and longitudinally overlapping the second high-frequency junction, said filtering means (1) having a stopband characteristic for blocking high-frequency signals having a polarization aligned with said second high-frequency junction, (2) having a passband characteristic for passing low-frequency signals to said low-frequency junction, (3) permitting unimpeded passage of signals having a polarization orthogonal to that of the blocked high-frequency signals, and (4) suppressing spurious excitation of signals in undesired propagation modes that would interfere with the desired signals being propagated through said combiner, means for coupling into said first high-frequency junction the high-frequency signals having a polarization orthogonal to that of said high-frequency signals blocked by said filtering means, and means for coupling into said low frequency junction the low-frequency signals passed by said filtering means.

* * * * *